United States Patent [19]

Wolfe

[11] Patent Number: 4,782,665

[45] Date of Patent: Nov. 8, 1988

[54] FROSTED CONDIMENT HOLDER

[76] Inventor: John J. Wolfe, Highway 69, P.O. Box 497, Savannah, Tenn. 38372

[21] Appl. No.: 35,826

[22] Filed: Apr. 8, 1987

[51] Int. Cl.[4] ..... F02K 5/00

[52] U.S. Cl. ..... 62/246; 312/284

[58] Field of Search ..... 62/246, 303; 312/284

[56] References Cited

U.S. PATENT DOCUMENTS

| | | | |
|---|---|---|---|
| 3,491,548 | 1/1970 | Christiansen | 62/246 |
| 4,407,143 | 10/1983 | Wolfe | 62/303 |
| 4,572,598 | 2/1986 | Moore, Jr. | 62/246 |

*Primary Examiner*—Henry A. Bennet

*Attorney, Agent, or Firm*—Fleit, Jacobson, Cohn & Price

[57] ABSTRACT

A frosted condiment holder provided with a frosted plate having a plurality of openings for supporting individual condiment containers with the plate having a layer of frost formed thereon due to refrigerant lines positioned thereunder in heat exchange relating thereto and in adjacent relation to the openings. The portion of the plate receiving the condiment containers is recessed downwardly in relation to the periphery of the plate in order to maintain the product in the upper portion of the condiment containers in a desired low temperature condition. The present invention further includes a heating wire at the periphery of the frosted plate to prevent the frost from travelling over the edge of the frosted plate.

7 Claims, 1 Drawing Sheet

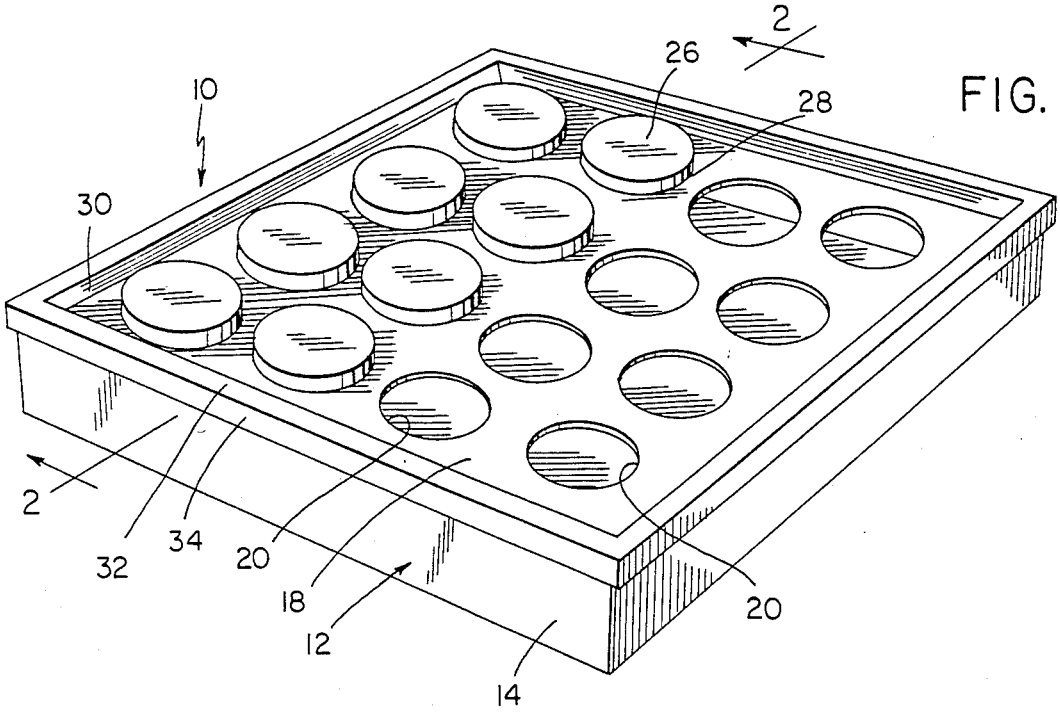
FIG. 1
FIG. 2
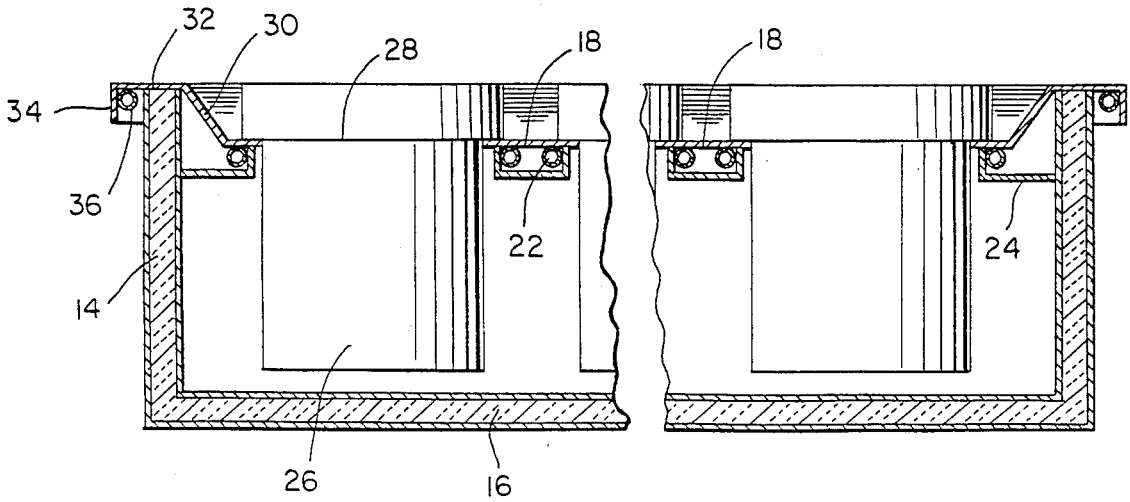

FROSTED CONDIMENT HOLDER

BACKGROUND OF THE INVENTION

The present invention generally relates to a frosted condiment holder provided with a frosted plate having a plurality of openings for supporting individual condiment containers with the plate having a layer of frost formed thereon due to refrigerant lines positioned thereunder in heat exchange relation thereto and in adjacent relation to the openings. The portion of the plate receiving the condiment containers being recessed downwardly in relation to the periphery of the plate in order to maintain the product in the upper portion of the condiment containers in a desired low temperature condition. The present invention further includes a heating wire at the periphery of the frosted plate to prevent the frost from travelling over the edge of the frosted plate.

INFORMATION DISCLOSURE STATEMENT

My prior U.S. Pat. No. 4,407,143 issued Oct. 4, 1983 for Frosted Condiment Holder discloses a plate-type holder with the present invention including improvements in the form of a recessed portion of the plate inwardly of the periphery thereof and a heating wire adjacent the periphery thereof. These features are not known in the prior art.

SUMMARY OF THE INVENTION

An object of the present invention is to provide a frosted condiment holder in the form of unique and novel improvements over that shown in my prior U.S. Pat. No. 4,407,143 which includes a frosted plate with openings receiving condiment holders with the major portion of the plate being recessed below the periphery thereof so that the product or condiment in the upper portion of the containers will be maintained at a desired lowered temperature by the cold air above the recessed portion of the plate being retained by the elevated periphery of the plate so that the upper end portions of the condiment containers will be cooled since the upper edges of the condiment containers will generally be aligned with the upper surface of the peripheral edge of the plate thereby assuring that the refrigerant lines in heat exchange relation to the plate will maintain the product or condiment in the containers at a desired lowered temperature level throughout the containers.

Another object of the invention is to provide a frosted condiment holder in accordance with the preceding object in which the peripheral edge of the frosted plate is provided with a heater wire to stop migration of frost over the peripheral edge of the plate thereby providing a clear line of demarcation between the edge of the frosted plate and a surrounding supporting structure or the like.

A further important object is the provision of a frosted condiment holder which is highly attractive and appetizing to observers by providing a frosted surface with the central portion of the plate and substantially the entire portion of the plate inwardly of the peripheral edge thereof being recessed with the periphery of the recess being defined by an upwardly sloping wall portion which will retain any condiment that may be inadvertently dropped or placed on the top surface of the plate with the device being simple in construction and operation, effective for maintaining the temperature of the product in the containers at a desired lowered temperature so that the entire contents of the condiment containers will be maintained in the best possible condition.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view illustrating the frosted condiment holder of the present invention with the unique features incorporated therein.

FIG. 2 is a sectional view, on an enlarged scale, taken substantially upon a plane passing along section line 2—2 on FIG. 1 illustrating the specific structural details of the improved and unique features of the invention.

DESCRIPTION OF THE PREFERRED EMBODIMENT

Referring now specifically to the drawings, the condiment holder of the present invention is generally designated by the numeral 10 and includes a generally rectangular shaped base 12 formed by insulated walls 14 and a bottom structure 16. The shape, configuration and size of the condiment holder may vary with the upper end thereof being closed by a frosted top plate 18 having a plurality of openings 20 therethrough which may be of any suitable standard sizes with refrigerant lines 22 being mounted below the plate 18 and in adjacent and enclosing relation to the openings 20 with the refrigerant lines being enclosed as at 24 so that the area of the condiment holder 10 below the plate 18 will be cooled for cooling condiment containers 26 which are inserted downwardly through the openings 20. The condiment containers 26 include a peripheral flange or ledge 28 engaging the upper surface of the plate 18 for limiting their insertion into the condiment holder with the upper end of the containers 26 extending above the plate 18.

The periphery of the plate 18 is provided with an upwardly inclined wall or flange 30 that terminates in a horizontal supporting flange 32 forming the periphery of the plate 18 and resting on or attached to the upper edge of wall 14. The periphery of the flange 32 is provided with a downturned flange 34 spaced from the outer surface of the wall 14 and a heating wire 36 is positioned in the interior of the corner junction between the horizontal flange 32 and the vertical flange 34 as illustrated in FIG. 2 with the heating wire serving to stop travel or migration of frost peripherally over the edge of the plate 18. The line of demarcation of the frost is very distinctly defined at the outer edge of the flange 32 due to the heating wire 36 melting any frost that tends to creep or migrate over the outer edge of the plate 18.

The inclined wall 30 recesses the portion of the plate 18 inwardly thereof at a vertical position below the horizontal plane of the flange 32 with the top edge of the condiment containers generally being in the same plane as the horizontal flange 32. The downwardly offset central portion of the plate 18 provides a cold sink or well which retains cold air along the top surface of the recessed portion of the plate and is in heat exchange relation to the upper end portion of the container 26 and the condiment products therein for maintaining the condiment products in the upper end portion of the containers 26 in a desired lowered temperature condition thereby preserving the products or condiments therein by maintaining them at a desired temperature and maintaining them in a more attractive and tasty condition.

In addition to the recessed plate 18 providing a well for maintaining cold air in heat exchange contact with the upper end of the containers and the condiment products therein, the inclined wall 30 also serves to retain any condiments that may become accidentally dropped or spilled onto the top from moving peripherally outwardly of the frosted top 18. This arrangement provides not only a frosted plate 18 but also a frosted inclined surface 30 and a frosted horizontal flange 32 with the heated wire precluding the frost from migrating or moving over the outer edge of the plate onto the peripheral portion of a surrounding supporting panel or surface such as a countertop, cabinet top or the like.

For the specific details of the mounting arrangement and control arrangement for the cooling refrigerant lines, the structure in prior U.S. Pat. No. 4,407,143 is referred to with the specific details disclosed in that patent relating to the remainder of the frosted condiment holder being incorporated herein. Essentially, the present invention includes the structural arrangement in which the portion of the plate that is frosted oriented inwardly of a raised peripheral edge being recessed so that the top edge portions or upper end portions of the containers will be cooled and the portion of the condiments at the upper end portions of the containers will also be maintained at a desired cooled temperature. In addition, the present invention involves the feature of providing a heating wire in the juncture between the flange 32 and flange 34 at the periphery of the frosted plate to prevent frost from migrating over the edge of the plate and to melt any frost that occurs in this area thereby providing a sanitary and attractive sharp edge to the frosted plate.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A refrigerated condiment holder comprising a frost top unit including a plate having a plurality of openings therethrough for receiving and holding condiment containers with the containers depending substantially into the area below said plate, refrigerant conduit means below said plate and in heat exchange relation thereto to form frost on the upper surface of said plate thereby forming a frost top unit, said refrigerant conduit means being disposed outwardly of the periphery of said openings and adjacent the undersurface of the plate to enable containers of different vertical dimensions to be fully inserted into the openings without contact with the refrigerant conduit means, said refrigerant conduit means being disposed adjacent the periphery of said openings to cool the area below the plate and maintain the containers and condiments therein at a substantially constant cool temperature, said plate having a recessed central area in which the openings are disposed and a raised periphery to form a cold air retaining well, the condiment containers extending above the plate and terminating generally in the same horizontal plane as the raised periphery of the plate so that the cold air in the well is in heat exchange relation with the upper end portion of the containers for maintaining the upper end portion of the containers and the upper end portion of the condiments contained therein at a desired lowered temperature.

2. The structure as defined in claim 1 wherein said raised periphery of the plate is provided with a heating wire along the under surface of the outer edge thereof to prevent migration of frost over the edge of the frosted plate.

3. The structure as defined in claim 1 wherein the raised periphery of the plate is joined to the recessed portion of the plate by a downwardly and inwardly inclined wall portion which maintains a well for cool air and retains condiments that may accidentally drop or spill onto the frosted plate.

4. The structure as defined in claim 2 wherein the raised periphery of said plate includes a downturned flange perpendicular thereto, said heating wire being disposed interiorly of the corner between the downturned flange and the raised periphery of the plate.

5. The structure as defined in claim 4 wherein the raised periphery of the plate is joined to the recessed portion of the plate by a downwardly and inwardly inclined wall portion which maintains a well for cool air and retains condiments that may accidentally drop or spill onto the frosted plate.

6. A refrigerated condiment holder comprising a frost top unit including a plate having a plurality of openings therethrough for receiving and holding condiment containers with the containers depending substantially into the area below said plate, refrigerant conduit means below said plate and in heat exchange relation thereto to form frost on the upper surface of said plate thereby forming a frost top unit, said refrigerant conduit means being disposed adjacent the periphery of said openings to cool the area below the plate and maintain the containers and condiments therein at a substantially constant cool temperature, said plate having a recessed central area in which the openings are disposed and a raised periphery to form a cold air retaining well, the condiment containers extending above the plate and terminating generally in the same horizontal plane as the raised periphery of the plate so that the cold air in the well is in heat exchange relation with the upper end portion of the containers for maintaining the upper end portion of the containers and the upper end portion of the condiments contained therein at a desired lowered temperature, said recessed central area of said plate being substantially planar with the openings through the plate being disposed in spaced relation to each other and in spaced relation to the raised periphery, said raised periphery on the plate including a planar portion parallel to but spaced above the recessed central area of the plate with the inner edge of the planar portion of the raised periphery being integral with a downwardly and inwardly inclined wall that is integral with the central recessed area of the plate, said planar portion of the raised periphery of the plate adapted to engage a supporting structure with the inclined wall retaining material on the central recessed area of the plate and serving as the periphery of the cold air well.

7. The condiment holder of claim 6 wherein said planar portion of the raised periphery of the plate includes a downturned flange at the outer edge thereof and a heating element positioned inwardly of the downturned flange in heat exchange relation to the flange and planar portion of the raised periphery to prevent migration of frost outwardly of the raised periphery of the plate beyond the heating element thereby retaining the outer peripheral portion of the plate in a frost-free condition.

* * * * *